United States Patent [19]

Landy

[11] Patent Number: 4,548,627

[45] Date of Patent: Oct. 22, 1985

[54] FUME HOOD WITH MODULAR BLOWER AND FILTER ASSEMBLY

[76] Inventor: Jerome J. Landy, 9175 Hammock Lake Dr., Miami, Fla. 33156

[21] Appl. No.: 605,833

[22] Filed: May 1, 1984

[51] Int. Cl.[4] ..... B08B 15/02

[52] U.S. Cl. ..... 55/385 A; 55/472; 55/473; 55/482; 55/502; 55/503; 55/DIG. 18; 98/36; 98/115.3

[58] Field of Search ..... 55/385 A, 472, 473, 55/482, 502, 503, 505, 506, DIG. 18, DIG. 29, 338; 98/36, 115 R, 115 LH

[56] References Cited

U.S. PATENT DOCUMENTS

| | | | |
|---|---|---|---|
| 3,492,112 | 2/1970 | Deckas | 55/DIG. 18 |
| 3,729,905 | 5/1973 | Diccianni | 55/473 |
| 3,926,597 | 12/1975 | Landy | 55/DIG. 18 |
| 4,045,192 | 8/1977 | Eckstein et al. | 55/385 A |
| 4,098,174 | 7/1978 | Landy | 55/DIG. 18 |
| 4,175,936 | 11/1979 | Lough et al. | 55/385 A |
| 4,249,463 | 2/1981 | Hornby | 98/115 LH |
| 4,312,291 | 1/1982 | Knab | 55/472 |

FOREIGN PATENT DOCUMENTS

| | | | |
|---|---|---|---|
| 1561978 | 3/1980 | United Kingdom | 55/482 |

*Primary Examiner*—David L. Lacey
*Attorney, Agent, or Firm*—Jack E. Dominik

[57] ABSTRACT

A modularized biohazardous fume hood in which a single unit retains a blower, and exhaust transition, and mount for the blower in a single package. The exhaust transition rides atop a non-metallic exhaust HEPA filter and therefore the non-metallic filter serves as a spacer as well as a sound and vibration deadener from the motor of the blower. Similarly, the base of the motor rests atop a second filter through which the recirculating air is driven downwardly over a diffuser and onto a work tray. The entire blower and exhaust transition rests atop the non-metallic HEPA filter, and therefore further sound and vibration deadening and space saving is achieved. Moreover, because the filters for the exhaust as well as the recirculating air are used as structural units, the amount of space can be minimized to the end that a commercial embodiment can be developed which is essentially twenty-four inches wide, twenty-four inches deep, and only fifty-four inches high and still provides a work area height of no less than 28 inches to allow for gravity fill of large I.V. bottles and pouches (shorter units are available 24×24×46").

7 Claims, 9 Drawing Figures

FUME HOOD WITH MODULAR BLOWER AND FILTER ASSEMBLY

FIELD OF THE INVENTION

The present invention relates to a laminar flow biological safety cabinet which generally is classified as a biohazardous fume hood. More particularly, the invention is directed to a modularized blower and filter assembly for use in such a biohazardous fume hood.

THE RELEVANT PRIOR ART

The relevant prior art is primarily that of the applicant, and more specifically U.S. Pat. Nos. 3,926,597 and 4,098,174.

The subject laminar flow biological safety cabinet fume hoods are developed to permit an operator to have access to a work tray where the access opening is under a viewing screen and is subject to a slight negative pressure at all times. Thus the make-up air goes into the hood and does not come out unfiltered after passing over any biohazardous materials which might be in a work area. HEPA (high efficiency particulate air) filter are used to filter the air.

The biohazardous fume hoods of the subject patents have been widely accepted, but because of their construction and size, a minimum space low cost unit for pharmacists, oncologists, nurses, radiolgists, microbiologists, and other technicians has not been available. In addition, in certain environments the prior art fume hoods can have a noise level in decibals above seventy. Finally, the biohazardous fume hoods of the prior art are built up step-by-step and integrated in such a fashion that they are difficult to disassemble once developed.

SUMMARY OF THE INVENTION

The subject invention involves a modularized biohazardous fume hood in which a single unit is developed to retain the blower, and exhaust, and mount for the blower in a single package. The exhaust transition is positioned on top of the exhaust HEPA filter and therefore the filter serves as a spacer as well as a sound and vibration deadener for the motor. Similarly, the motor base resets atop a second filter through which the recirculating air is driven downwardly over a diffuser and onto the work tray. The entire blower and transition unit rests atop the supply HEPA filter, and therefore further sound and vibration deadening and space saving is achieved. Also the structural weight on both filters produces a gravity asserted seal at the gaskets for the filters. Moreover, because the filters for the exhaust as well as the recirculating air are used as structural units, the amount of space can be minimized to the end that a commercial embodiment can be developed which is essentially twenty-four inches wide, twenty-four inches deep, and only fifty-four inches high and still provides a work area height of no less than 28 inches to allow for gravity fill or large I.V. bottles and pouches (shorter units are available 24×24×46").

In view of the foregoing it is a principal object of the present invention to provide a modular construction for a biohazardous fume hood which permits minimal space, and in which the two primary HEPA filters are utilized as a structural member to further reduce space and to assist in noise and vibration deadening.

Another object of the present invention is to form a biohazardous fume hood in which the units are assembled sequentially, and as a consequence can, in their final form, be directly dropped into the cabinet which cabinet is previously fabricated.

Yet another object of the present invention is to provide such a biohazardous fume hood with a modularized interior construction which, in addition, has a modularized instrument panel which is accessible entirely from the front.

BRIEF DESCRIPTION OF THE DRAWINGS

Further objects and advantages of the present invention will become apparent as the following description of an illustrative embodiment takes place, taken in conjunction with the accompanying drawings, in which.

DESCRIPTION OF PREFERRED EMBODIMENTS

Figure 3:
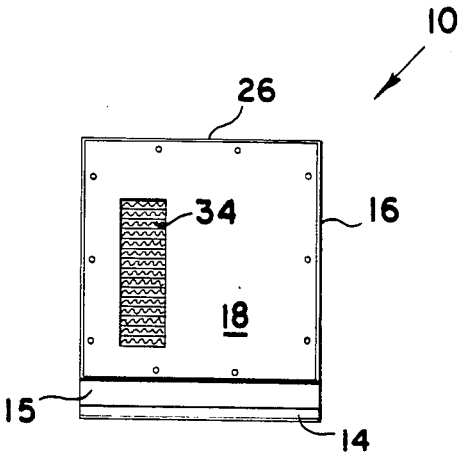
FIG. 3 is a top view of the subject fume hood.
Figure 1:
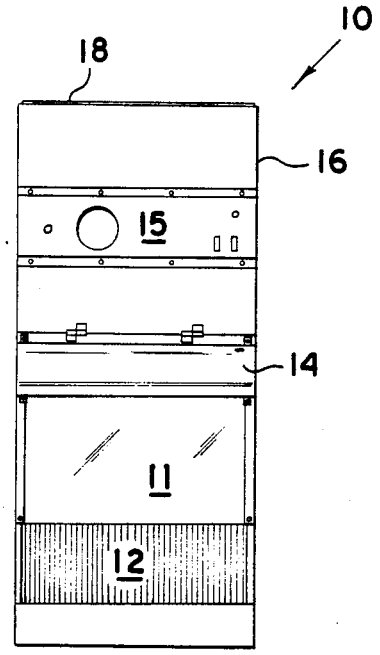
FIG. 1 is a front elevation of the subject illustrative fume hood.
Figure 2:
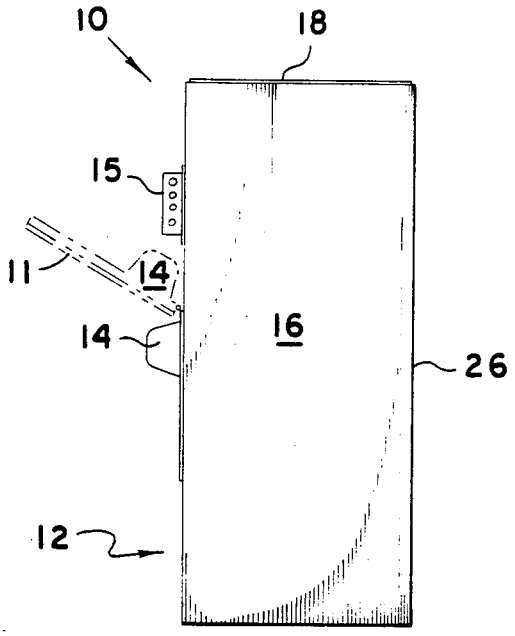
FIG. 2 is a side elevation of the subject fume hood.

The subject fume hood 10, as shown in FIG. 1, has a viewing screen 11 with an opening 12 therebeneath for the operator to manipulate experiments and other activities interiorly of the fume hood 10. Provision is made for a light housing 14 immediately above the viewing screen 11, and a removable control panel 15 is provided above the light housing. The sides 16 (as shown in FIG. 2) are essentially imperforate. Also as noted in FIG. 2, the viewing screen 11 and light housing 14 elevate together. The top 18 as shown in FIG. 3 is gasketed and removable from the balance of the frame and contains the exhaust transition exit as will be described in detail later.

One of the objectives of the subject design of the fume hood 10 is to achieve compaction. For example, a desirable embodiment is fifty-four inches high, twenty-four inches wide, and twenty-three and one-half inches deep. The total depth, measured to the outer edge of the light housing 14, is twenty-seven and one-half inches.

Figure 4:
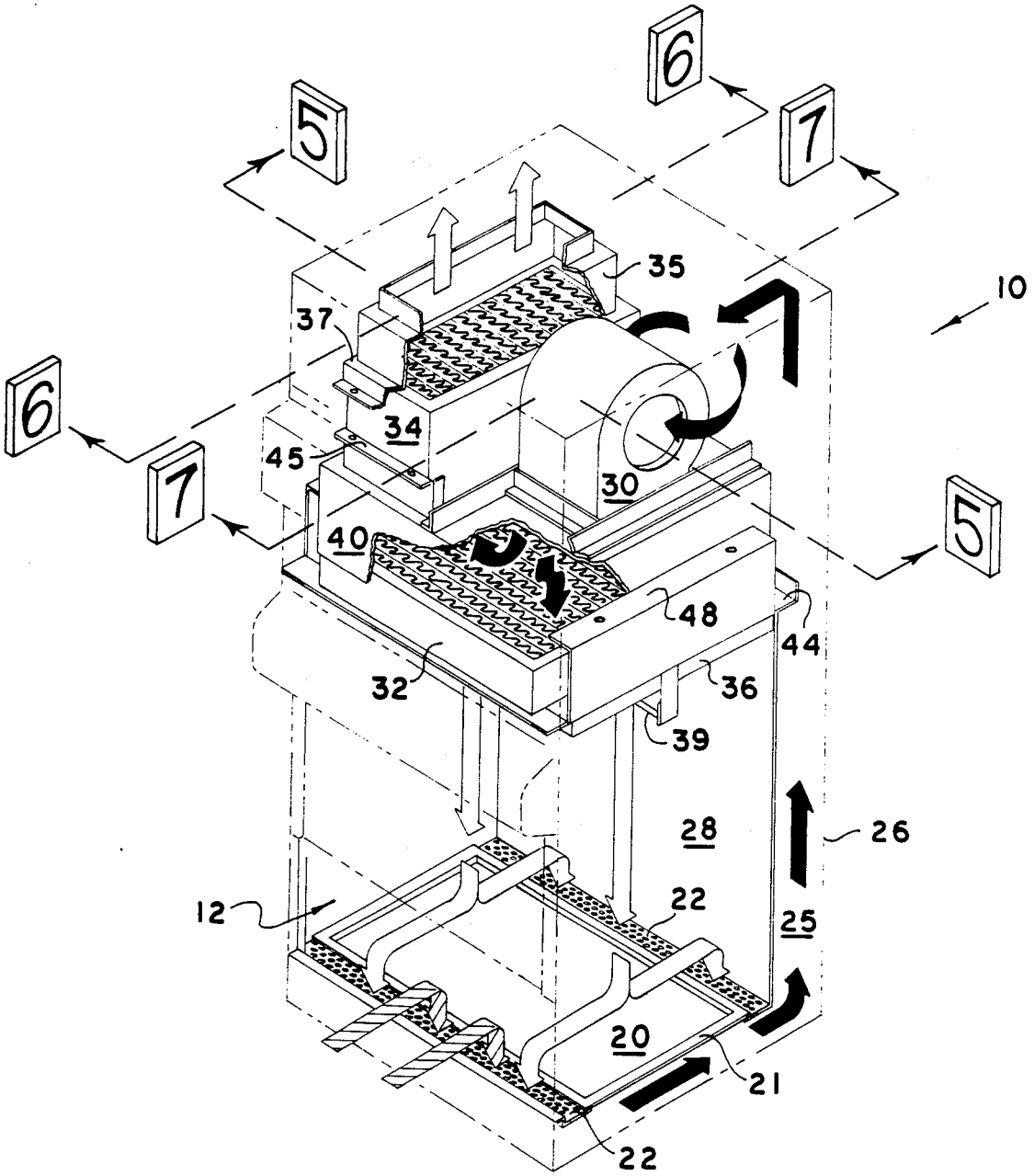
FIG. 4 is a partially broken perspective view diagrammatically illustrating the air flow in the subject fume hood.
Figure 7:
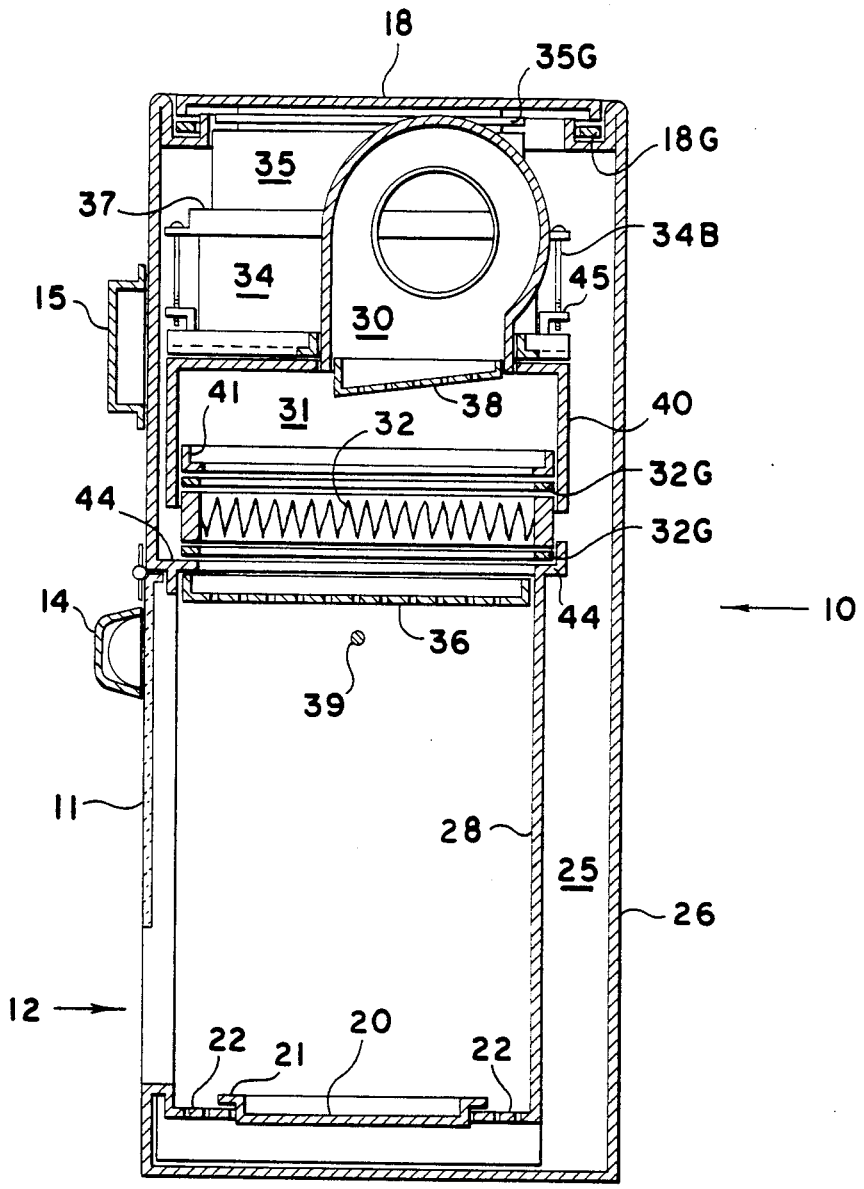
FIG. 7 is another sectional view taken along section line 7—7 of FIG. 4.

As noted in FIG. 4, the work tray 20 is provided with a work tray flange 21 which sits atop the air intake grills 22. An exhaust chamber is provided underneath the work tray 21 and leads, as shown by the dark arrows, to the rear plenum 25 defined by the back wall 26 of the fume hood 10, and an interior back panel 28 which leads upwardly from the air intake grills 22 to the blower module. As shown in FIG. 7, an IV (intra venus) container mount bar 39 is strung along underneath the diffuser 36. Similarly a blower baffle 38 is provided underneath the blower motor assembly 30.

Figure 5:
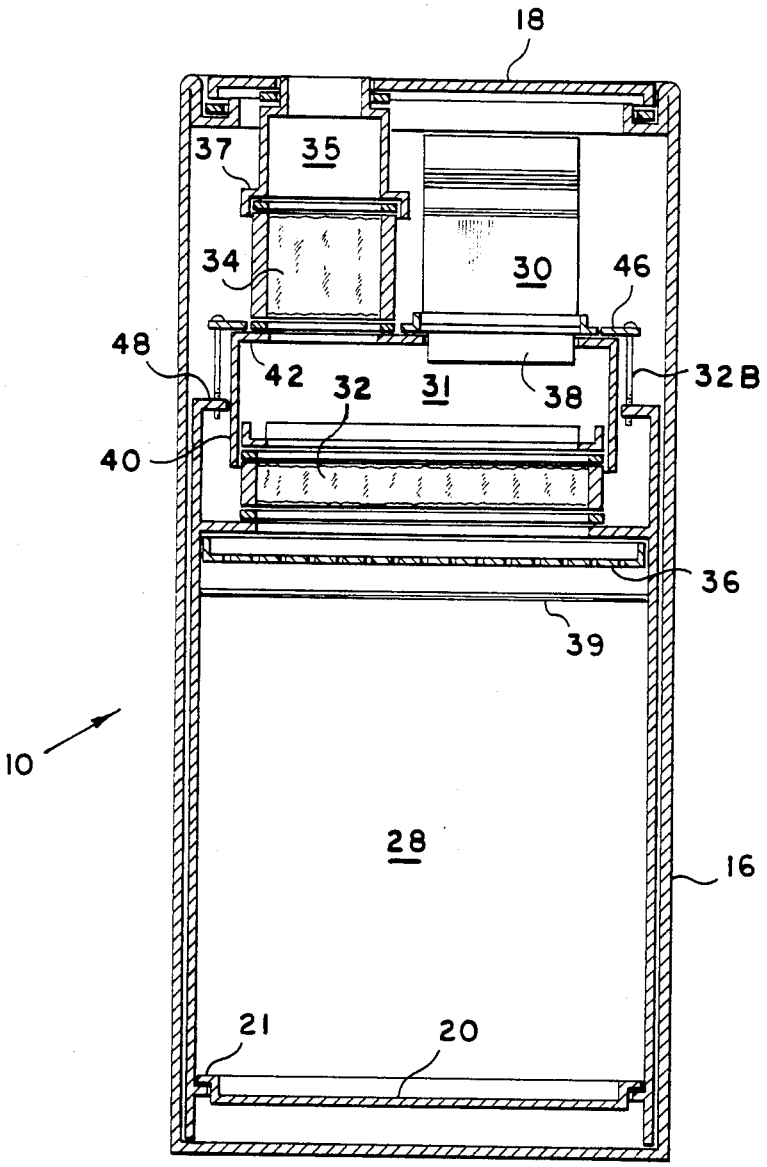
FIG. 5 is a transverse sectional view of the subject fume hood taken along section line 5—5 of FIG. 4.
Figure 6:
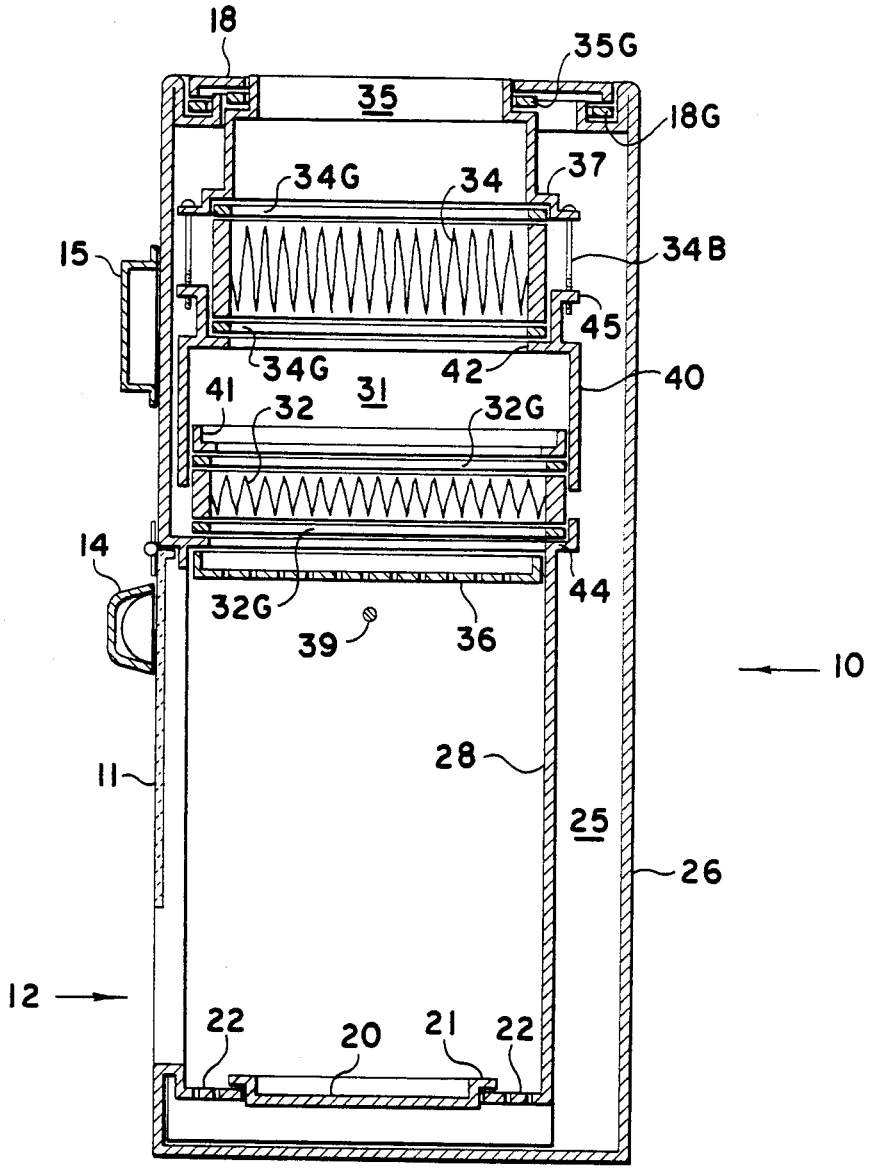
FIG. 6 is a further transverse sectional view taken along section line 6—6 of FIG. 4.

A significant aspect of the invention relates to the positioning and proportioning and mounting of the blower assembly 30, the supply filter 32, and the exhaust filter 34 all as shown in FIG. 4. In the subject construction the frame of the supply filter 32 and the frame of the exhaust filter 34 becomes structural elements of the filter and blower assembly. The plenum frame 40, as seen in FIGS. 5–7, has an upper portion in which the blower and motor 30 are mounted. Supply filter rails 41 support the plenum frame 40 atop the supply filter 32. A depending skirt from the plenum frame 40 further assures alignment about the supply filter 32. In addition, a supply filter shelf 44 is provided at the upper portion of the interior back 28, and a front flange supports the supply filter 32 immediately above the viewing screen 11.

The supply filter 32 is a HEPA (high efficiency particulate air) filter with a 99.99% efficient probe test having a dimension of 20"×20"×3". The exhaust HEPA filter has dimensions of 8"×18", being $5\frac{7}{8}$" in depth, as contrasted with the 3" depth of the supply filter. The exhaust amounts to about 40% of air which passes through the blower 30.

The exhaust filter 34 is mounted within the exhaust transition unit 35. The exhaust transition 35 has a lower flange 37 which sets atop the exhaust filter 34. To be noted is that gaskets 32G, 34G are provided at the periphery of both the supply filter 32 and exhaust filter 34.

Further, in accordance with the invention, tiebolts 34B are employed to secure the exhaust transition 35 atop the exhaust filter 34. Similarly, tiebolts 32B are provided to secure the plenum frame onto the supply filter 32. In this fashion all of the metallic and functional portions of the supply filter 32, exhaust filter 34, and blower motor 30 are tied together. The filters are sandwiched into the construction minimizing space, and insuring a non-metal-to-metal support of the interior frame elements. Thus compaction is achieved. Also a gravity assist is added to the gasketing of both the supply filter 32 and exhaust filter 34.

Figure 8:
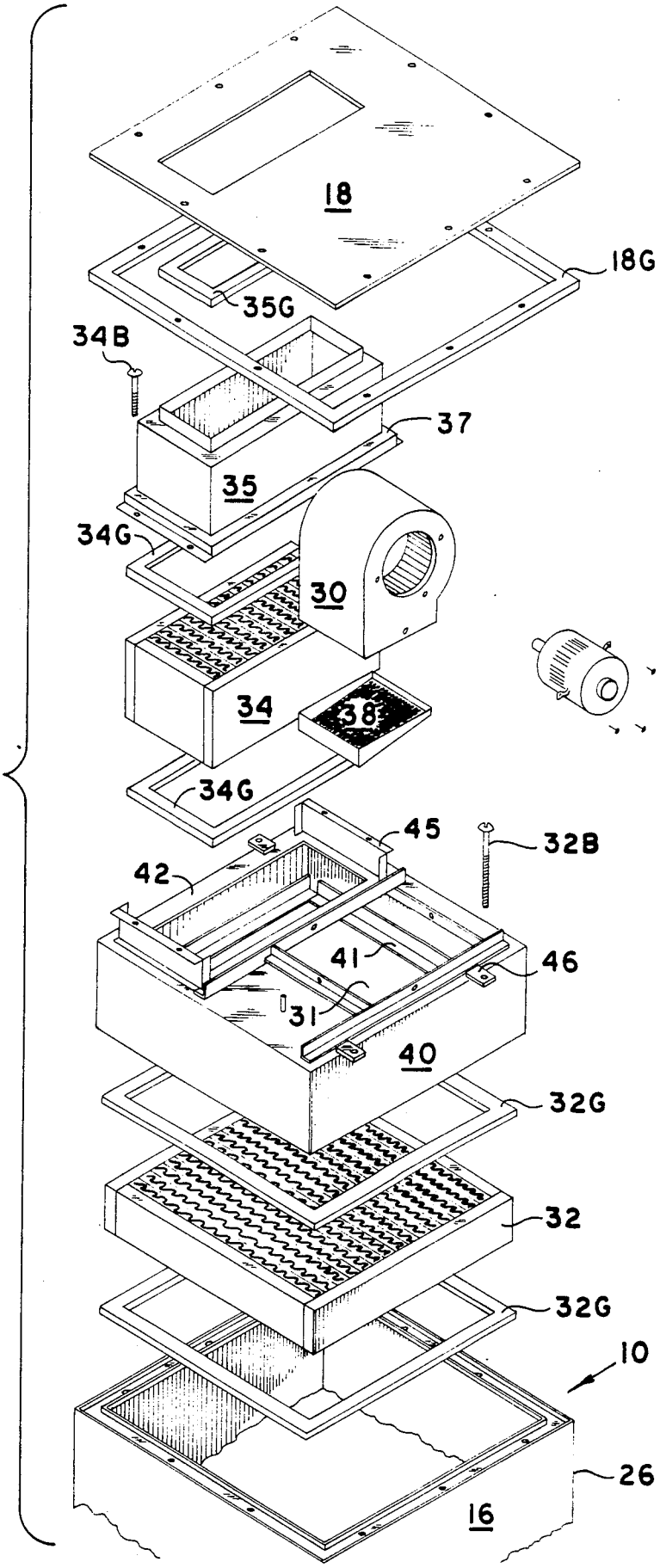
FIG. 8 is an exploded perspective view of the exhaust transition module.

Referring now to FIG. 8, it will be seen how the exhaust transition 35 is sequentially secured to the plenum frame 40. The exhaust transition 35 is positioned above the exhaust filter gasket 34G, exhaust filter 34, and the lower exhaust filter gasket 34G to ride atop the exhaust filter shelf 42. The tiebolts 34B pass through holes in the lower edge of the exhaust transition 35, and engage the tiebolt holes provided in the end flanges 45 at the upper portion of the plenum frame 40. The motor blower assembly 30 is secured in the opening provided in the plenum frame 40 above the blower baffle 38.

Figure 9:
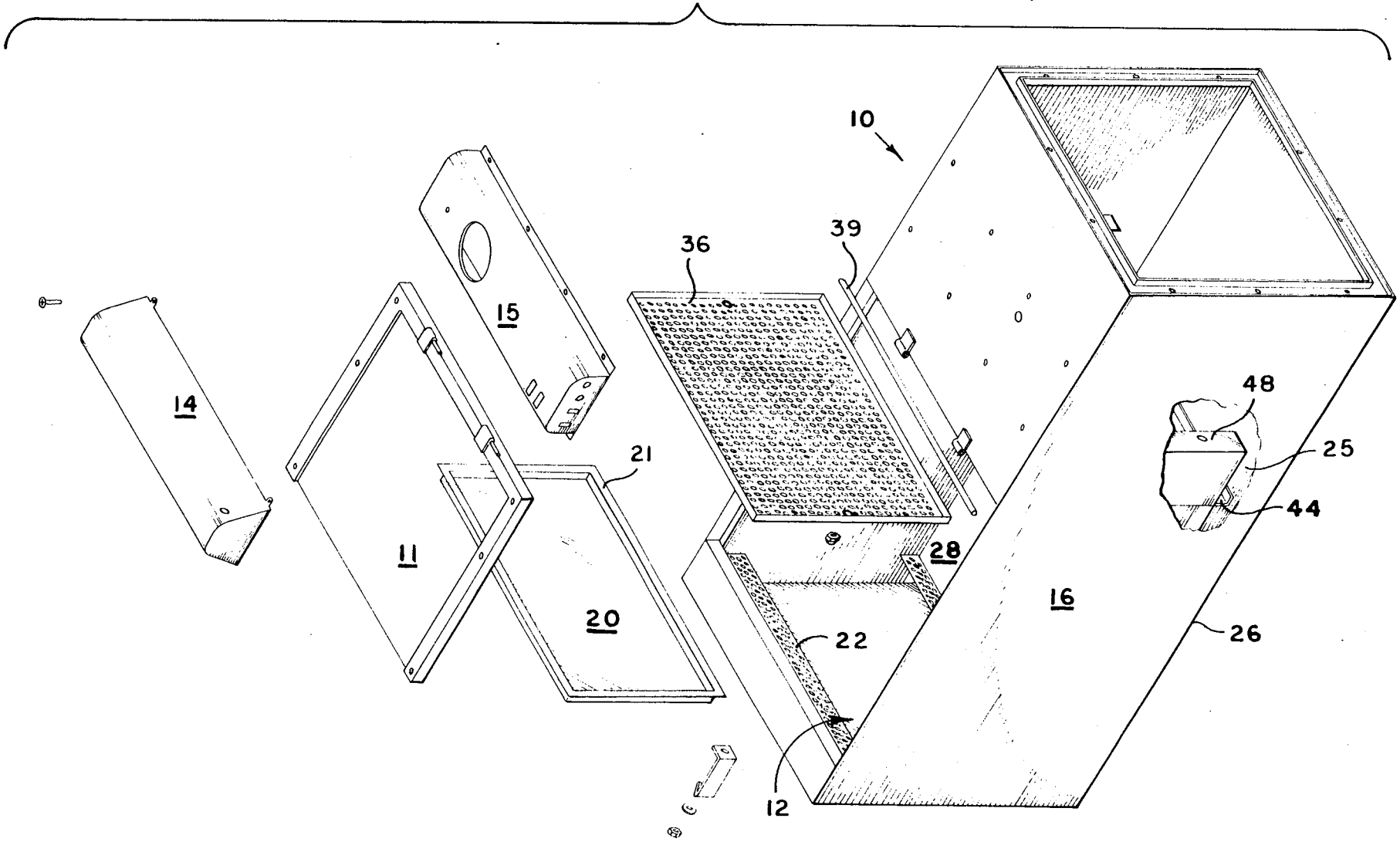
FIG. 9 is a further exploded perspective view of the components of the subject fume hood.

Considering FIGS. 8 and 9 together, it will be seen that the entire exhaust assembly is then positioned atop the supply filter 32 and its flanking gaskets 32G to ride on the supply filter sheld 44 interiorly of the cabinet 10. Additional tiebolts 32B pass through tabs 46 flanking the plenum frame 40, and are secured to anchor flanges 48 provided inside the cabinet 10. The unit is completed by securing the top 18 to the top gasket 18G at the top of the fume hood 10.

In assembling the subject fume hood, the diffuser 36 is first mounted within the fume hood 1 above the work tray 20. The diffuser 36 is preferably fabricated out of a 0.040 inch perforated aluminum plate with $\frac{1}{8}$ inch holes on 3/16 inch staggered centers. Then the blower motor is prepared for mounting, and it is mounted with the blower atop the diffusion chamber 31 on the plenum frame 40. Thereafter the exhaust HEPA filter 34 is mounted on top of the plenum frame 40 being gasketed at the top and the bottom. The exhaust transition 35 is then mounted on top of the exhaust HEPA filter 34 and secured by tiebolts. The control panel 15 and light housing 14 with viewing screen 11 is then mounted to the front of the fume hood 10.

As a final step in assembly, the supply filter 32 is secured in place, and thereafter the combination of the plenum 40, exhaust filter 34, and exhaust transition 35 are simultaneously lowered into the fume hood 10. FIGS. 6 and 7 show the assembled relationship where it will be noted that both of the filters 32, 34 serve as structural elements in a stack. Most HEPA filters are of a non-metallic material, which has some yieldability. Accordingly they serve to deaden vibration and deaden sound. In addition, the weight of the exhaust transition 35 and the plenum frame 40 tends to further secure the gasketed seal above and below each of the HEPA filters.

In review there has been disclosed a motor and supply and exhaust filter system in which the filters serve as structural separators when sandwiched between the exhaust transition and the plenum. The filters are secured by tiebolts as well as gravity in firm gasketed relationship with the air flow directing members of the unit. The air flow, in turn, follows the path as generally diagrammed in FIG. 4 where the dark arrows indicate contaminated air, the white arrows indicate filtered air, and the arrows with the crosshatching are make up air coming in through the opening 12 beneath the viewing screen 11.

Although particular embodiments of the invention have been shown and described in full here, there is no intention to thereby limit the invention to the details of such embodiments. On the contrary, the intention is to cover all modifications, alternatives, embodiments, usages and equivalents of a filter and blower assembly for fume hood as fall within the spirit and scope of the invention.

What is claimed is:

1. In a bio hazardous fume hood having a frame, plenum, and work area comprising, in combination, a blower motor assembly, an exhaust transition, said frame having an opening therein receiving the blower motor assembly, an exhaust filter, said frame having means for anchoring the exhaust transition, said exhaust transition having a lower portion positioned on top of the exhaust filter, said frame having an exhaust filter shelf receiving and supporting the lower portion of the exhaust filter, means for securing the exhaust transition to the frame, a supply filter, said frame having an interior shelf supporting the supply filter, said blower motor assembly positioned on top of the supply filter and in communication with the plenum, and means for securing the blower and said filter to a shelf in the fume hood for supporting the entire unit with the exhaust transition and the frame sandwiching the exhaust filter and supply filter.

2. In the biohazardous fume hood of claim 1 above, further comprising, tie bolt like members securing the exhaust filter and supply filter within the frame.

3. In the biohazardous fume hood of claim 1, said frame having an interior set of opposed rails engaging the upper portion of the supply filter.

4. A biohazardous fume hood, comprising, in combination, a frame, said frame supporting a centrally mounted work tray, a viewing screen at the front of the frame overlooking the working tray and having an opening beneath it to permit the hands of a technician access to the work tray and allow make up air to enter, an air exhaust path beneath the work tray and upwardly along the rear of the working tray, a first supply filter in communication with said air path and secured to said frame enclosure, a plenum chamber within said frame, a blower mounted atop the first supply filter and in communication with the plenum for delivering filtered air from above the work tray, a second filter in communication with the plenum positioned to exhaust filtered air from the hood, and an exhaust transition atop said second filter and secured to the frame, whereby both the recirculating and exhaust filters become structural mounting elements.

5. In the fume hood of claim 4, further including tiebolt means connecting the exhaust transition to the frame.

6. In the fume hood of claim 4, wherein said frame has opposed rails supporting the lower portion of the supply filter.

7. In the fume hood of claim 4, further including gaskets positioned above and below each of said filters.

* * * * *